US005440291A

United States Patent [19]

Foster, Jr. et al.

[11] Patent Number: 5,440,291

[45] Date of Patent: Aug. 8, 1995

[54] INTRUDER DETECTION SYSTEM FOR PASSAGEWAYS AND THE LIKE

[75] Inventors: Melvin P. Foster, Jr., Santa Clarita; James M. Woodward, Lake View Terrace, both of Calif.

[73] Assignee: Lockheed Corporation, Calabasas, Calif.

[21] Appl. No.: 84,721

[22] Filed: Jul. 1, 1993

[51] Int. Cl.[6] ..... G08B 13/26

[52] U.S. Cl. ..... 340/562; 340/541

[58] Field of Search ..... 340/562, 561, 541, 573, 340/572, 563, 564, 596; 324/658, 686, 696

[56] References Cited

U.S. PATENT DOCUMENTS

| | | | |
|---|---|---|---|
| 2,971,184 | 2/1961 | Pearson et al. | 340/564 |
| 3,031,643 | 4/1962 | Sheftelman | 340/564 |
| 3,047,849 | 7/1962 | Hansen | 340/564 |
| 3,110,891 | 11/1963 | Herrick et al. | 340/564 |
| 3,372,319 | 3/1968 | Rhodes | 340/562 |
| 3,375,511 | 3/1968 | Trimble et al. | 340/561 |
| 3,623,061 | 11/1971 | Mayhew et al. | 340/562 |
| 4,254,413 | 3/1981 | Mongeon | 340/561 |
| 4,366,473 | 12/1982 | Inoue et al. | 340/564 |
| 4,518,953 | 5/1985 | Hunter et al. | 340/564 |
| 4,684,931 | 8/1987 | Parks | 340/561 |
| 4,866,424 | 9/1989 | Parks | 340/572 |
| 5,051,727 | 9/1991 | Fockens | 340/572 |
| 5,126,749 | 6/1992 | Kaltner | 340/572 |

*Primary Examiner*—Edward L. Coles, Sr.
*Assistant Examiner*—Fan Lee

[57] ABSTRACT

The invention is a system for detecting the presence of an intruder in a passageway. In detail, the system includes at least one capacitance probe for mounting on the wall of the passageway, the probe including a sensing member in the form of a rod extending into the passageway, the number, spacing and length of the sensing members sufficient to detect an intruder attempting to pass through the passageway.

6 Claims, 3 Drawing Sheets

INTRUDER DETECTION SYSTEM FOR PASSAGEWAYS AND THE LIKE

BACKGROUND OF THE INVENTION

1. Field of the Invention

The invention relates to the field of intruder detection systems and, in particular to an inexpensive intruder detection system for small passageways such as air conditioning systems and the like.

2. Description of Related Art

In many facilities, specially those storing government classified materials and the like, it is essential to know that an intruder has attempted to gain entrance, whether or not the attempt was successful. Thus all such facilities incorporate alarm systems to detect intruders such as motion, proximity and sound detectors, in addition to the typical access control. However, these are normally installed in occupied rooms and hallways. In passageways, such as heating and air condition ducts that are not subject to daily inspection, steel bars are installed to prevent access. However, steel bars can be cut and some period of time may pass before normal inspections will detect the break in. In addition, any alarm system for use in such passageways must use incombustible materials because of government fire codes.

Of course motion detectors can be used, but they are expensive and not suited for use in environments where large temperature fluctions occur. Capacitance grids are some times used, however, they must be custom built to fit the particular passageway, must be isolated from the metal wall and can not be made from materials that can burn or cause smoke when subject to the heat from a fire. Thus they are also expensive to manufacture.

Thus, it is a primary object of the invention to provide a system to detect intruders in a passageway.

It is another primary object of the invention to provide a system to detect intruders in a passageway wherein the system is readily adaptable to passageways of varying sizes and shapes.

It is a further object of the invention to provide a system to both detect intruders in a passageway and deter entrance therein.

SUMMARY OF THE INVENTION

The invention is a system for detecting the presence of an intruder in a passageway such as an air conditioning duct or the like. In detail, the system includes at least one capacitance probe for mounting on the wall of the passageway. The probe includes a base member mounted to one wall of the passageway, having a sensing member in the form of a solid conducting rod extending into the passageway. In most applications, more than one probe will be required; thus the number, spacing and length of the sensing members are selected to insure the detection of an intruder attempting to pass through the passageway. Typically, in rectangular, trapezoidal, or other multisided passageways, the sensing elements are placed 5 inches from each other and extend to within one inch of the opposite wall. In a circular shaped passageway, the probes can be mounted in a circle with their sensing elements pointed at the center thereof. The probes are electrically connected in series to a control box.

Preferably, the sensing elements are removably mounted to the probe such that sensing members of different lengths can be installed thereon allowing the system to be used on passageways of different sizes and shapes using a common base member. Additionally, the probes, if built strong enough, can be used to prevent the intruder from progressing along the passageway. In this regard, to provide additional support for the sensing member, a hollow support member can be installed on the opposite wall having an electrically insulated hole adapted to receive the end of the sensing member. Thus with both ends of the sensing member supported, it would be far more difficult for an intruder to break or bend the sensing member over.

The novel features which are believed to be characteristic of the invention, both as to its organization and method of operation, together with further objects and advantages thereof, will be better understood from the following description in connection with the accompanying drawings in which the presently preferred embodiments of the invention are illustrated by way of example. It is to be expressly understood, however, that the drawings are for purposes of illustration and description only and are not intended as a definition of the limits of the invention.

DESCRIPTION OF THE PREFERRED EMBODIMENT

Figure 1:
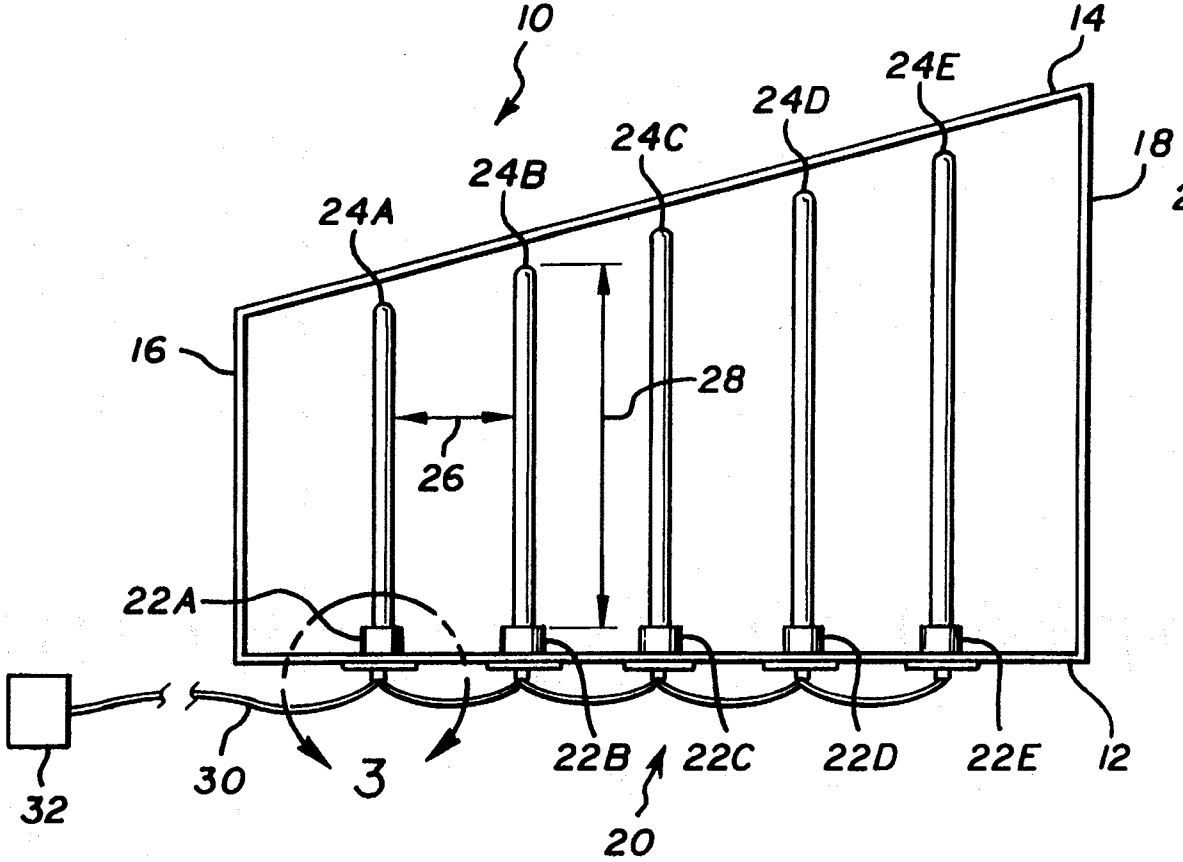
FIG. 1 is a cross-sectional view of a passageway having the subject intruder detection system installed therein.

Illustrated in FIG. 1 is a cross-sectional view of a trapezoid shaped passageway, generally indicated by numeral 10. The passageway 10 is representative of the types of passageways found in buildings, such as heating and air conditioning ducts. The passageway includes a bottom wall 12, top wall 14, and side walls 16 and 18. A intruder detection system for passageways and the like, generally indicated by numeral 20, is shown installed in the passageway 10.

The system 20 includes a plurality of capacitance probes 22A–22E mounted on the wall 12, having sensing members 24A–24E extending into the exterior of the passageway 10. The number of probes 22 will vary from as low as a single probe on upward; the number depending on the size and shape of the passageway. For example, Government requirements dictate that the spacing 26 between probes must be six inches or less (the same as would be required for steel bars), and must come within five inchs of the opposite wall 14 which determines the required length 28 of the sensing members 24A–24E. The probes are connected in series by a wire 30 which connects to a controller 32. A suitable control box is manufactured by Perimeter Products, Mountain View, Calif. under the tradename PROX-WATCH. Of course, there are numerous other such devises on the market that are suitable for use with this system.

Figure 2:
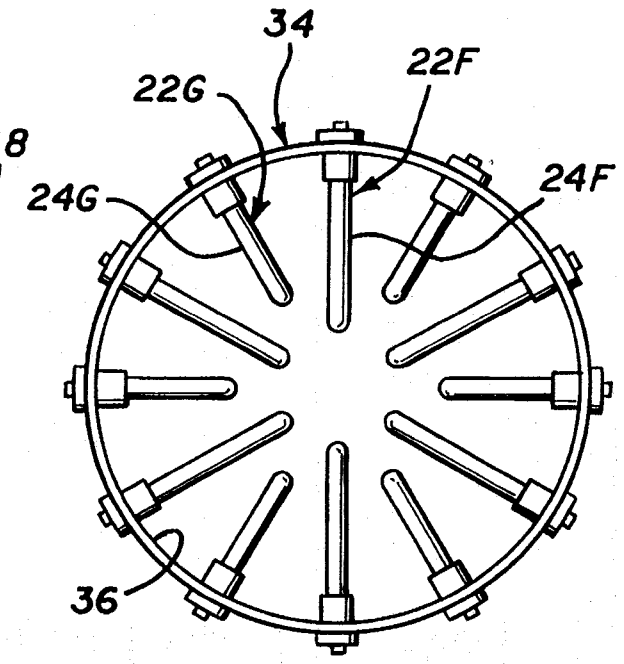
FIG. 2 is a cross-sectional view of a circular passageway having the subject intruder detection system installed therein.

A circular shaped passageway, indicated by numeral 34 is illustrated in FIG. 2 wherein probes 22F having long sensing elements 24F are alternated with probes 22G having short sensing elements 24G extend radialy inward from the interior of the wall 36. Thus it should be apparent that the system 20 could be used with almost any size or shape duct.

Figure 3:
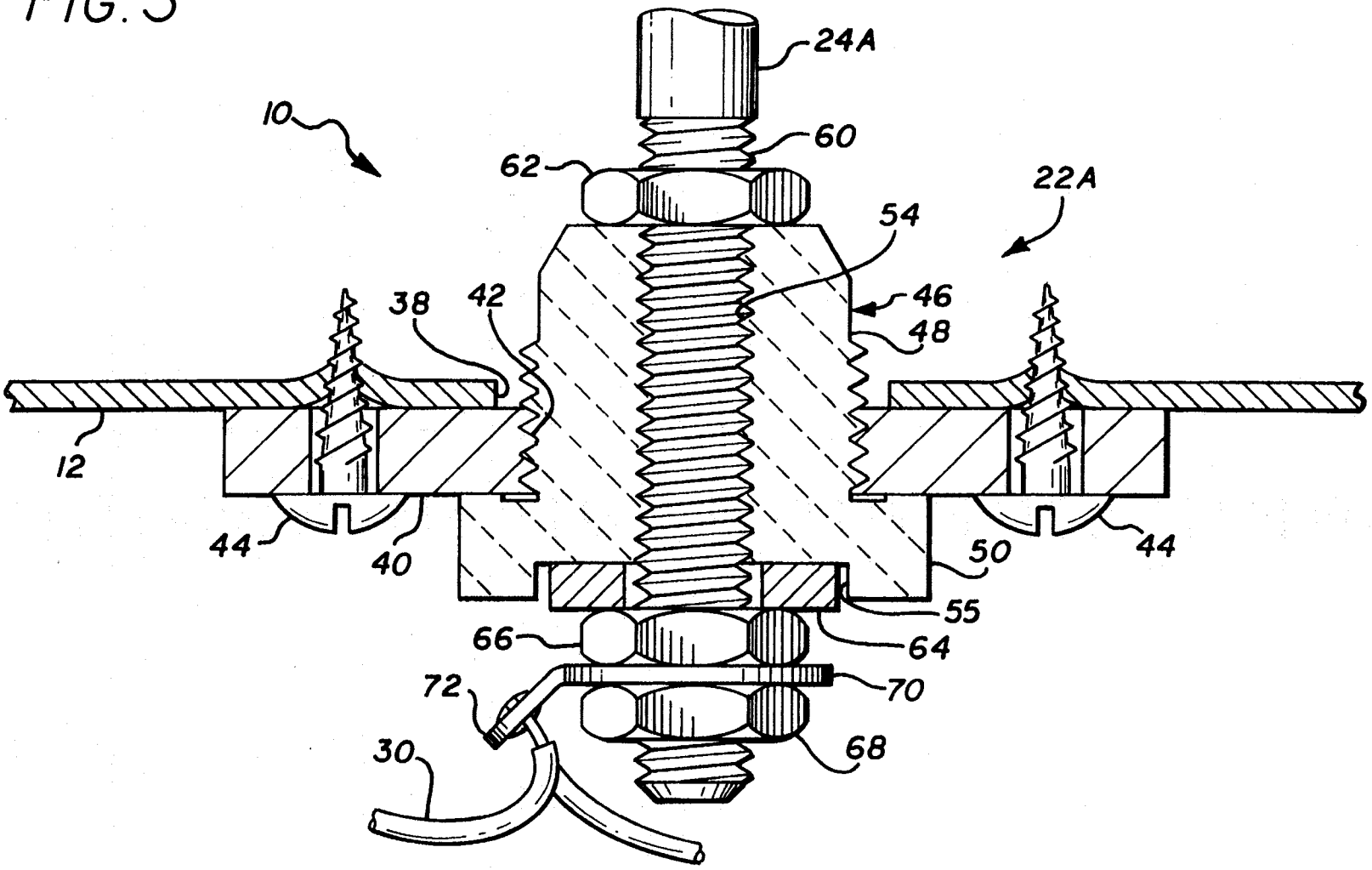
FIG. 3 is an enlarged view of a portion of FIG. 1 encompassed by the circle indicated by numeral 3 illustrating one of the proximity sensing probes making up the system.

Referring to FIG. 3 it can be seen that the wall 12 of the passageway 10 incorporates a hole 38 to accommodate the probe 22A. Note that the following detailed description of the probe 22A is applicable to the other probes 22B–22E. The probe 22A includes a mounting flange 40, having a threaded hole 42, and is mounted to the wall 12 by means of fasteners 44, which as illustrated are self threading screws. A member 46 having a threaded body 48 and flange portion 50, is threadably engaged to the flange 40. A threaded hole 54 extends through the member 46 and terminates in a counter bore 55 in the flange 50. T h e sensing member 24A includes a threaded portion 60 that engages the threaded hole 54 and extends through the counter bore 55. It secured to the member 46 by means of jam nut 62. A washer 64 is mounted in the counter bore 55 and about the end 60 of the sensing member 24A and is secured by a pair of locknuts 66 and 68 having a washer 70 therebetween. The washer 70 includes a connecting tab 72 to which the wire 30 is joined by solder. The two jam locknuts 66 and 68 secure the washer 70 while the washer 64 distributes the load into the member 46.

All the components of the probe 22A can be made of metal except the member 46 which must be non-conducting. The member preferably is made of a ceramic material because it is a dielectric material and is non-combustible. Note again that government regulations dictate that combustible materials or materials that will create smoke that can not be use in such passageways. Additionally, the use of a metal sensing member 24A adds considerable strength making it difficult to remove or break.

Figure 4:
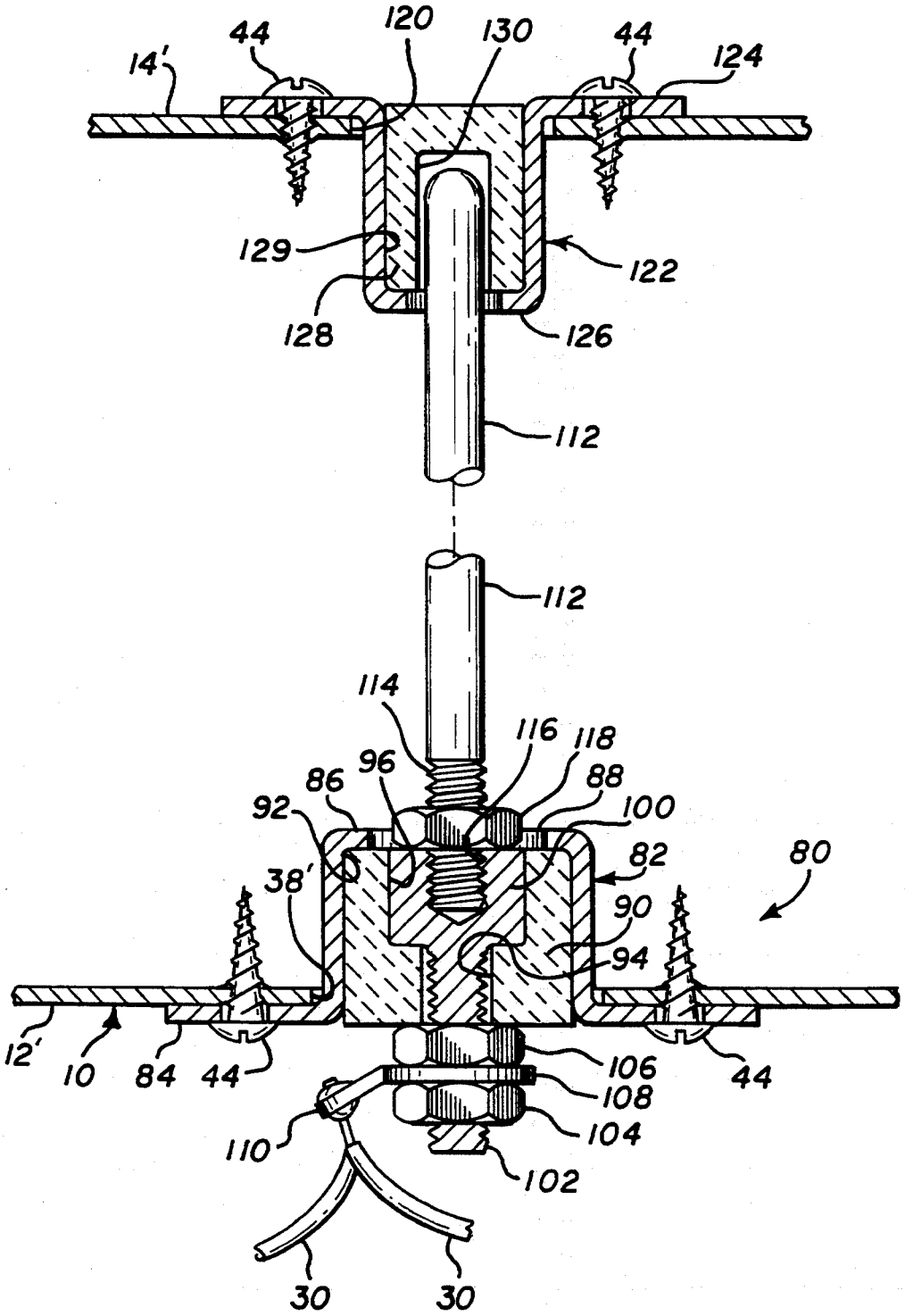
FIG. 4 is a view similar to FIG. 3 illustrating a second embodiment of the invention.

Providing increased prevention against the ingress of an intruder into the passageway along with a detection system can be accomplished by providing greater support for the sensing members. This is provided with the embodiment illustrated in FIG. 4. The bottom wall 12' of the duct 10 includes a hole 38' enlarged to receive a modified sensing probe, generally indicated by numeral 80. The probe 80 includes a hollow cylindrical shaped housing 82 having an outward flange 84 mounted to the wall 12' by fasteners 44, and an inward facing flange 86 at the opposite end forming an aperture 88. A insulating insert 90, preferably made of ceramic material, is mounted in the housing 82 abutted against the flange 86 and bonded to the interior wall 92 of the housing. The insert 100 includes a hole 94 therethrough having a counterbore 96. A conducting insert 100 having a threaded shaft 102 is mounted in the counterbore 96 of the insert 90 such that the shaft 102 extends through and out of the hole 94. The insert 100 is secured to the insert 90 by means of locknuts 104 and 106 having a washer 108 therebetween. The wire 30 is joined (soldered) to a tap 110 extending from the washer 108. A sensing member, in the shape of a solid conducting rod 112 has a threaded end 114 engaged with a threaded hole 116 in the insert 90 and is locked thereto by jam nut 118.

The wall 14' includes a hole 120 located opposite the hole 38' in the wall 12'. A hollow housing 122 having an outward flange 124 is secured to the wall 14' by fasteners 44 and an inward facing flange 126 at the opposite end. An insulating insert 128, preferably made of ceramic material, is mounted in the housing 122 abutted against the flange 126 and bonded to the interior wall 129 of the housing. The insert 128 includes a hole 130 extending only partially therethrough adapted to receive a portion of the sensing member 112. Thus the sensing member is supported at both it's ends and, thus, can withstand much higher forces.

The advantage of this probe design is that the sensing member, being easily removable from the insert 100, allows the quick substitution of a different size to accommodate passageways of different shapes and sizes. However, once installed it can not be easily removed. This is because even if the sensing member 112 where disconnected from the insert 100 it is still "trapped" in the hole 130 of the insert 128. Of course, the mounting method illustrated in FIG. 3 could be used on both walls providing even more support and, in addition is far more tamper proof, in that the sensing member is restrained by fasteners located outside of the passageway.

While the invention has been described with reference to a particular embodiment, it should be understood that the embodiment is merely illustrative as there are numerous variations and modifications which may be made by those skilled in the art. Thus, the invention is to be construed as being limited only by the spirit and scope of the appended claims.

INDUSTRIAL APPLICABILITY

The invention has applicability to all industries involved in the manufacture and use of security systems.

We claim:

1. A system for detecting the presence of an intruder in an enclosed passageway, the system comprising at least one capacitance probe for mounting on a wall of the passageway, said probe including a sensing member in the form of a ridged rod having a first end supported by the wall and a second end protruding into the passageway and not supported by an opposite wall, the number and spacing and the length of said sensing member of said at least one probe sufficient to detect an intruder attempting to pass through the passageway.

2. The system as set forth in claim 1 wherein said sensing member is a solid conducting rod.

3. The system as set forth in claim 2 further comprising means to support the second end of said sensing member mounted on the wall opposite the wall mounting said at least one capacitance probe.

4. The system as set forth in claim 3 wherein said means to support the second end of said sensing member comprises a housing having a closed end passage adapted to receive the second end of said sensing member, said passage lined with a non-conductive material.

5. The system as set forth in claim 1 or 2 or 3 or 4 wherein said sensing member is removably mounted on said probe such that sensing members of different lengths can be installed thereon allowing the system to be used on passageways of different sizes and shapes.

6. The system as set forth in claim 1, or 2, or 3, or 4 wherein the number of said at least one capacitance probe and the length of said sensing member thereof and the position therein within the passageway is sufficient to prevent the intruder from moving passed said at least one capacitance probe.

* * * * *